US008537010B2

(12) United States Patent
Hamm et al.

(10) Patent No.: US 8,537,010 B2
(45) Date of Patent: Sep. 17, 2013

(54) AUTOMATED VAULT MAPPING AND SECURITY SYSTEM

(75) Inventors: Dennis Hamm, Malibu, CA (US); Dennis Van Swol, Everest, KS (US); Marilyn Van Swol, Everest, KS (US)

(73) Assignee: PSSI International, Inc., Glendale, CA (US)

( * ) Notice: Subject to any disclaimer, the term of this patent is extended or adjusted under 35 U.S.C. 154(b) by 628 days.

(21) Appl. No.: 12/693,971

(22) Filed: Jan. 26, 2010

(65) Prior Publication Data

US 2011/0181413 A1 Jul. 28, 2011

(51) Int. Cl.
*G08B 13/00* (2006.01)

(52) U.S. Cl.
USPC ..... 340/541; 340/540; 340/686.1; 109/1 S; 109/3; 109/21; 109/31; 109/32; 109/38; 109/39

(58) Field of Classification Search
USPC ..... 340/541
See application file for complete search history.

(56) References Cited

U.S. PATENT DOCUMENTS

| | | | | |
|---|---|---|---|---|
| 7,836,452 | B2 * | 11/2010 | Taylor | 718/104 |
| 2001/0018660 | A1 * | 8/2001 | Sehr | 705/5 |
| 2002/0156645 | A1 * | 10/2002 | Hansen | 705/1 |
| 2005/0179553 | A1 * | 8/2005 | Fujie | 340/573.4 |
| 2006/0181392 | A1 * | 8/2006 | Watson | 340/5.73 |
| 2007/0132844 | A1 * | 6/2007 | Katz | 348/140 |
| 2008/0150678 | A1 * | 6/2008 | Giobbi et al. | 340/5.2 |
| 2008/0265019 | A1 * | 10/2008 | Artino et al. | 235/379 |
| 2009/0307255 | A1 * | 12/2009 | Park | 707/102 |

* cited by examiner

*Primary Examiner* — George Bugg
*Assistant Examiner* — Anthony D Afrifa-Kyei
(74) *Attorney, Agent, or Firm* — Blakely Sokoloff Taylor & Zafman, LLP

(57) ABSTRACT

A system and method to enhance vault security and management. An identity of a user is electronically validated. A floor plan of the vault and associated location of an authorized resource is retrieved in access computer. The user is then signaled a location of the resource within the vault.

5 Claims, 9 Drawing Sheets

Nest Elimination Selection

_ = 0%, L<25%, , X > 75%
M •• Between 25% and 75%

Update Box Status

| Delete | | Sizes | Percentages Rnt–Oos | | Stack/ Nest | Rented | Total | 2x5 | 3x5 | 5x5 | 3x10 | 5x10 | 6x10 | 9x10 | 10x10 |
|---|---|---|---|---|---|---|---|---|---|---|---|---|---|---|---|
| ☑ | 16x32-S | 3x5 | M | L | 1.1 | 8 | 30 | | 8 | | | | | | |
| ☐ | 16x32-S | _x10 | M | L | 1.2 | 4 | 6 | | | | | | 2 | 2 | |
| ☑ | 16x32-S | 3x5 | M | L | 1.3 | 11 | 30 | | 11 | | | | | | |
| ☐ | 16x32-S | _x10 | M | _ | 1.4 | 4 | 6 | | | | | | 2 | 2 | |
| ☑ | 16x32-S | 3x10 | M | _ | 2.1 | 8 | 15 | | | | 8 | | | | |
| ☑ | 16x32-S | 3x10 | M | M | 2.2 | 8 | 15 | | | | 8 | | | | |
| ☐ | 45x32-S | _x10 | M | L | 2.3 | 19 | 24 | | | | 9 | 6 | | | 4 |
| ☐ | 36x43-S | _x10 | M | L | 3.1 | 19 | 28 | | | | 14 | | | | 5 |
| ☐ | 52x43-S | mixed | M | L | 3.2 | 35 | 52 | | 3 | | 16 | 13 | | | 3 |
| ☑ | 44x32-S | mixed | M | L | 4.1 | 27 | 51 | 9 | 6 | | 1 | 8 | | | 3 |
| ☑ | 44x32-S | mixed | M | L | 4.2 | 24 | 51 | 12 | 3 | | 1 | 6 | | | 2 |
| ☐ | 35x32-sS | _x10 | M | L | 5.1 | 17 | 27 | | | | 12 | 5 | | | |
| ☐ | 53x32-sS | mixed | L | L | 5.2 | 16 | 105 | 4 | 6 | 1 | 2 | 3 | | | |
| ☑ | 44x27-sS | mixed | M | L | 6.1 | 23 | 53 | 3 | 3 | 7 | 8 | 2 | | | |
| ☑ | 44x32-S | _x5 | M | L | 6.2 | 26 | 100 | 25 | 1 | | | | | | |
| ☐ | 44x32-S | mixed | M | L | 7.1 | 28 | 75 | 18 | 5 | | 2 | 1 | | | 2 |
| ☐ | 44x32-S | mixed | M | L | 7.2 | 19 | 63 | 7 | 2 | 5 | 1 | 2 | | | 2 |
| ☐ | 44x32-S | mixed | M | L | 8.1 | 28 | 75 | 17 | 5 | | 1 | 2 | | | 3 |
| ☑ | 44x32-S | _x5 | M | L | 8.2 | 36 | 120 | 35 | 1 | | | | | | |
| ☐ | 44x32-S | mixed | M | L | 9.1 | 27 | 63 | 10 | 5 | 5 | 2 | 2 | | | 3 |
| ☑ | 44x32-S | 3x5 | L | L | 9.2 | 27 | 84 | | 17 | | | | | | |
| ☑ | 16x21-S | 3x5 | L | L | 10.1 | 2 | 20 | | 2 | | | | | | |
| ☐ | 16x21-S | 10x10 | M | _ | 10.2 | 3 | 4 | | | | | | | | 3 |
| ☐ | 45x21-S | mixed | M | L | 10.3 | 18 | 24 | | 10 | | | 4 | | | 4 |

| Sq Ft | | Nests | Total | 2x5 | 3x5 | 5x5 | 3x10 | 5x10 | 6x10 | 9x10 | 10x10 |
|---|---|---|---|---|---|---|---|---|---|---|---|
| 11,523 | Rented–Eliminated | 12 | 207 | 84 | 69 | 7 | 26 | 16 | 0 | 0 | 5 |
| 22,073 | Available–Retained | 24 | 321 | 145 | 99 | 7 | 41 | 14 | 2 | 1 | 12 |
| **10,550** | **Difference** | | **114** | **61** | **30** | **0** | 15 | -2 | 2 | 1 | 7 |

FIG. 4B

AUTOMATED VAULT MAPPING AND SECURITY SYSTEM

BACKGROUND

1. Field of the Invention

Embodiments of the invention relate to vault security. More specifically, embodiments of the invention relate to methods and systems for ensuring authorized access to vault resources.

2. Background

Efficient utilization of vault space and controlling access such that only authorized users have access to resources in the vault, such as safety deposit boxes, represents an ongoing challenge for banks. This challenge has been exacerbated by bank mergers and consolidations which have resulted in the requirement that banks combine safety deposit boxes from two or more prior entities into a single system. As banks merge, it becomes essential to be able to eliminate under utilized resources to permit resources from the merging entities to be combined within the vault.

Historically, banks have used a signature card system as the sole method for tracking and verifying access to safety deposit boxes. Under this system, a user presents their identification to a teller and signs a card to be granted access. The signed card is then retained as proof of access. While the teller is nominally supposed to compare the signatures on the identification card with that the user signs concurrently, tellers by and large are not handwriting experts nor are they necessarily qualified to identify a fraudulent identification card.

Although it has always been problematic to control access to, for example, safety deposit boxes, as banks have moved away from the small, local bank where most clients were known to the bank staff to greater anonymity, the traditional control method described above in many cases fail to provide sufficient access control. Moreover, this paper record has made producing the annual audit of vault access error-prone and labor-intensive. A better system of vault management is desirable.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

FIG. 4B is a screenshot of a matrix for use in nest elimination selection.

DETAILED DESCRIPTION

Figure 1A:
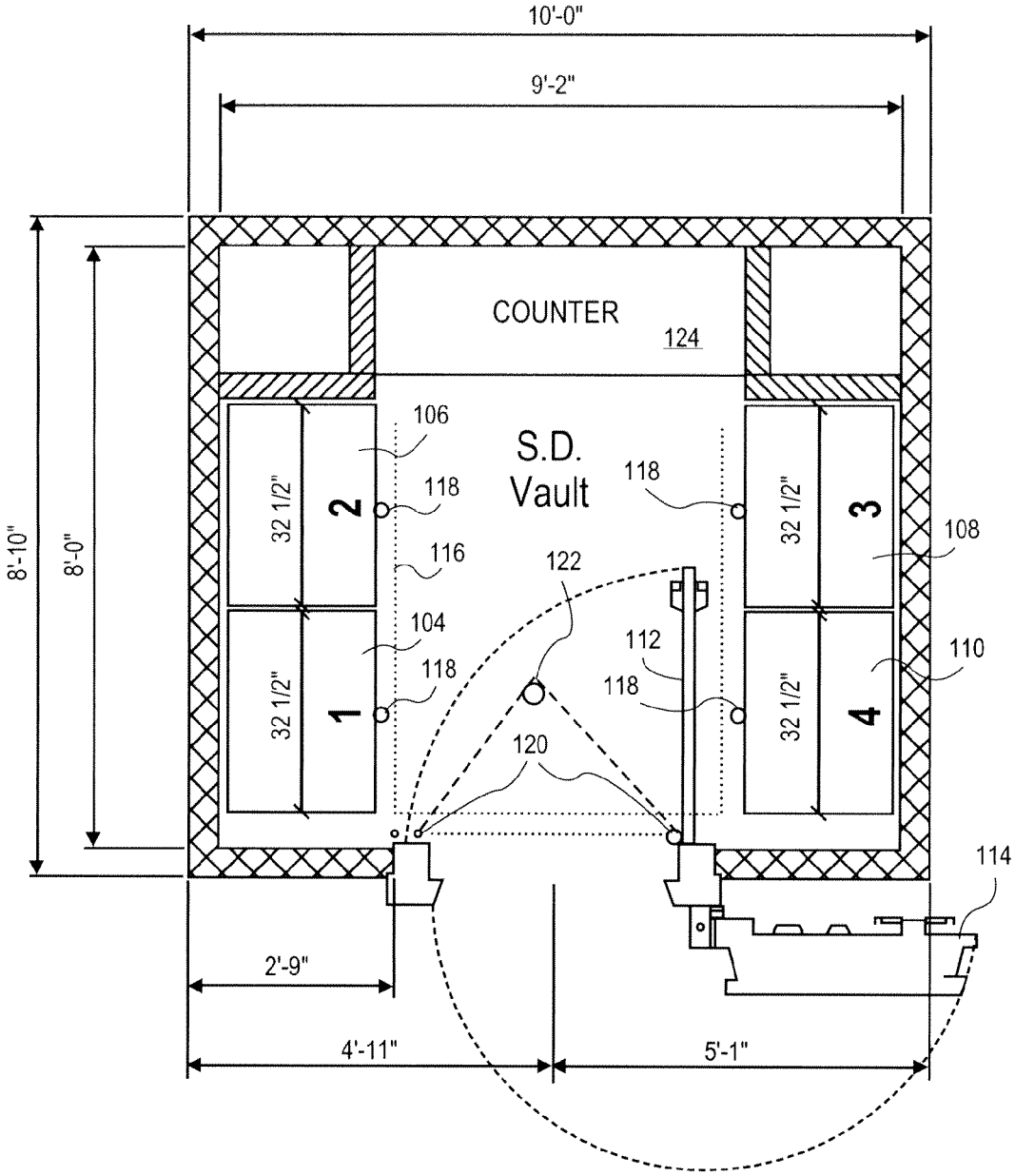
FIG. 1A is a schematic view of a floor plan of a safety deposit box vault into which one of the embodiments of the invention may be implemented.

FIG. 1A is a schematic view of a floor plan of a safety deposit box vault into which one of the embodiments of the invention may be implemented. Vault 102 has a simple, rectangular shape with four stacks 104, 106, 108, 110 of safety deposit boxes. The four stacks are in two elevations. Stacks 104, 106 are a first elevation and stacks 108, 110 are a second elevation. Generally, "elevation" refers to the nests/stacks in one linear area, e.g., along one wall. The particular floor plan shown is relatively simple. However, the system described herein is applicable to substantially any floor plan and is particularly beneficial where the floor plan is complex such as, where multiple rows (elevations) of stacks of safety deposit boxes exist with the vault.

The vault 102 is equipped with a counter 124 on which a user may place their safety deposit box when removed from its respective stack. The vault 102 is equipped with a day gate 112 that is locked during the day to control access to the vault 102. The vault door 114 is closed at night to render the vault 102 secure during non-business hours. In one embodiment of the invention, floor path lighting 116 is provided within the vault 102 to guide a user to a location of resource, e.g., their safety deposit box, for which they have authorized access. In some embodiments of the invention, lights 118 may be provided proximate to each stack to signal a user which stack contains the authorized resource. Other lighting configurations to signal the user to the location of the authorized resource are also within the scope and contemplation of embodiments of the invention. Outwardly facing camera 122 may be mounted within vault 102 to image users entering or leaving the vault 102. In one embodiment, sensors 120 are positioned to activate camera 122 when a user enters or leaves vault 102. In some embodiments, sensors 120 may include a photo interrupter or similar mechanism to signal when a user passes through the vault entrance.

Figure 1B:
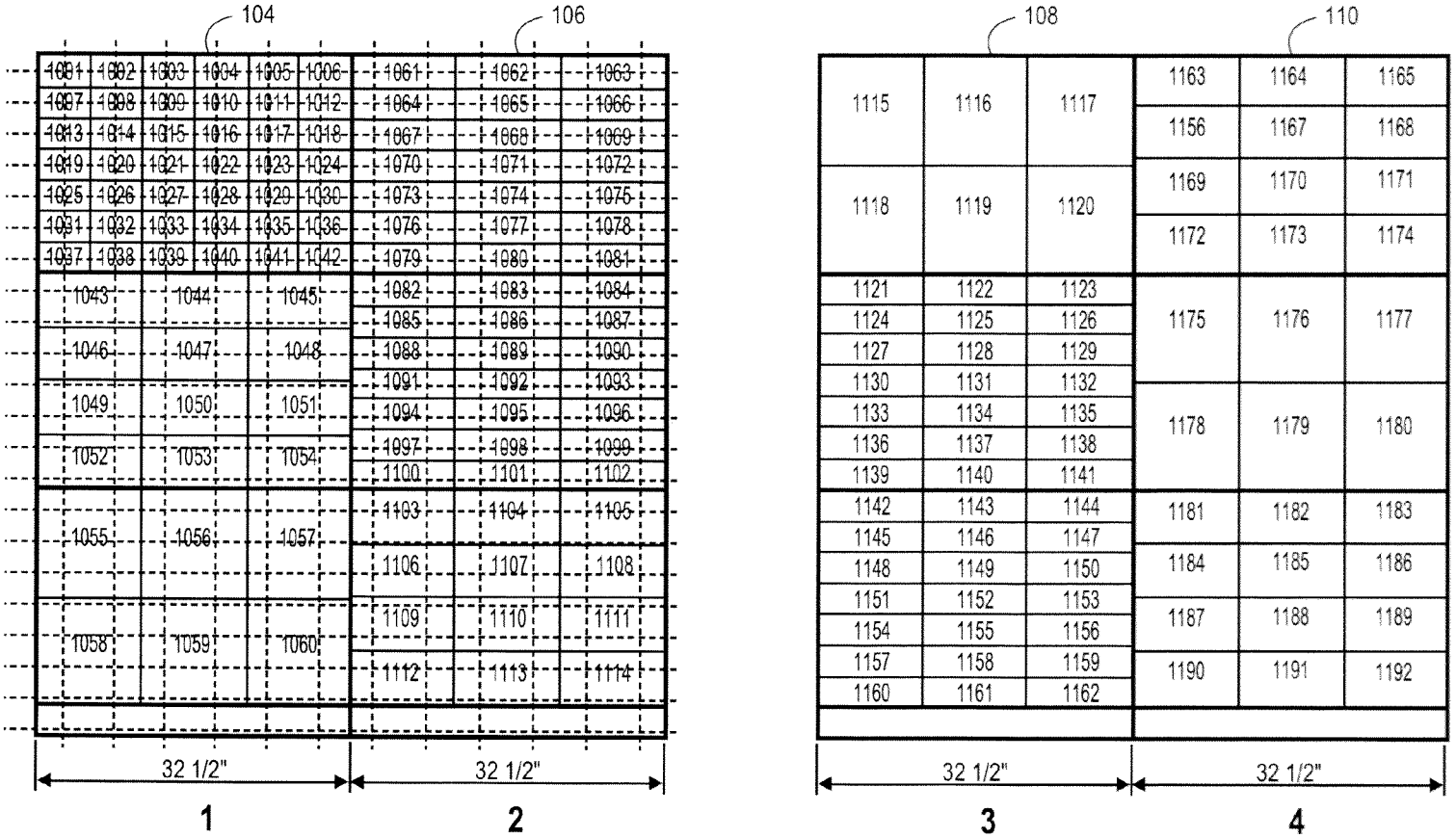
FIG. 1B is a schematic view of a set of safety deposit box stacks.

FIG. 1B is a schematic view of a set of safety deposit box stacks. Stack 104 includes safety deposit boxes 1001-1060, stack 106 includes 1061-1114, stack 108 includes 1115-1162 and stack 110 includes 1163-1192. Each stack includes three nests; for example, stack 104 includes nest 152, nest 154 and nest 156. Nests can be configured in various manners to hold various numbers and sizes of safety deposit boxes. While the safety deposit boxes shown in FIG. 1B are numbered consecutively, that may not be the case and in fact, as a result of mergers, box number duplication, as well as consolidation and reconfiguration, it is seldom the case in practice. Non-consecutive numbering leads to increased difficulty in finding a particular resource unless appropriate guidance is supplied, such as lighted path 116 in FIG. 1A.

In addition to aiding a user in finding their authorized resource, it is desirable to ensure that no unauthorized resource is accessed. To that end as described further below, it is desirable to electronically monitor the unauthorized resources while the user is unattended in the vault to insure no unauthorized access occurs. Pragmatically, it is not permissible to use surveillance cameras as the sensitive nature of the contents of the safety deposit boxes requires that a level of privacy is maintained. To provide for the electronic monitoring, some embodiments of the invention employ a laser range sensor, ultrasonic sensors or infrared light emitting diode sensors that form a grid in close proximity to the surface of the face of e.g., the stacks 104, 106 (as shown in FIG. 1B). Other embodiments may use triangulation using multiple sensors to note a change in the location of a signal reflected off the door of the safety deposit box, or a reflector on the door. The stack data from the range sensor is fed to an access computer. Because the access computer knows the physical coordinates of the authorized resource e.g., box 1080 an interruption of the grid at those coordinates is expected. However, an interruption caused by e.g., the removal of a box 1056 would not be expected and would trigger an alert. In some embodiments, a time threshold for the interruption exists such that an alert is only signaled if the grid is interrupted for e.g., greater than one second. This threshold reduces false alerts caused by a user inadvertently interrupting the grid in the normal course. While, in some cases tagging each resource with an RFID (radio frequency identification) tag would allow monitoring of the unauthorized resources, practically this cannot be done with the installed base of safety deposit boxes as installation of the RFID tags would require access to the inside of all the boxes, which is not practical. In another embodiment, video recognition may be used. For example, a video camera may have pixels of its view mapped to locations of an elevation. Without capturing and storing the images software can algorithmically determine a location a user seeks to access and send the coordinates in, e.g., x and y to the access computer to verify that the access is authorized.

Figure 1C:
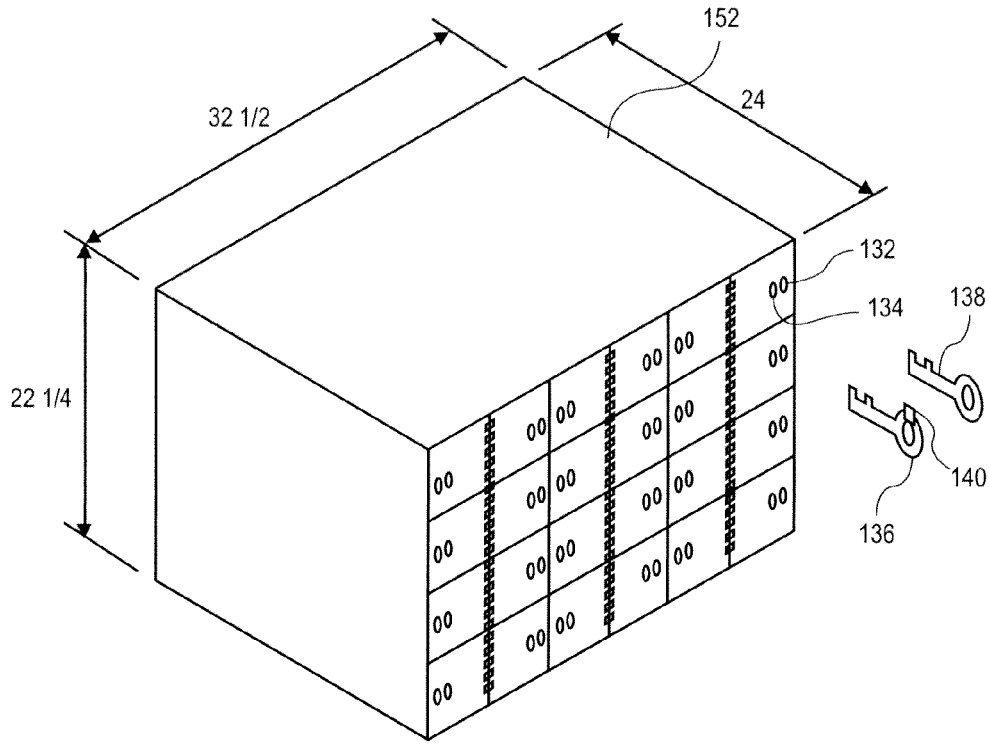
FIG. 1C is a schematic view of a typical safety deposit box nest that may be used in conjunction with one embodiment of the invention.

FIG. 1C is a schematic view of a typical safety deposit box nest that may be used in conjunction with one embodiment of the invention. Safety deposit box nest 130 is a typical dual-key box system. With dual-key box systems, two keyholes 132 and 134 exist for each box. To access a box it requires both a teller key 136 and a box key 138. Typically, the teller key 136 is a master key and can be used with multiple boxes; for example, all boxes in nest 152 may use the same teller key. By providing a radio frequency identification (RFID) tag associated with teller key 140 and appropriate sensing devices within vault 102, it is possible to discern if a user seeks to access a resource other than an authorized resource. This provides an alternative mechanism (instead of the sensor grid) for electronically monitoring for unauthorized access where a two key system is employed.

Figure 2:
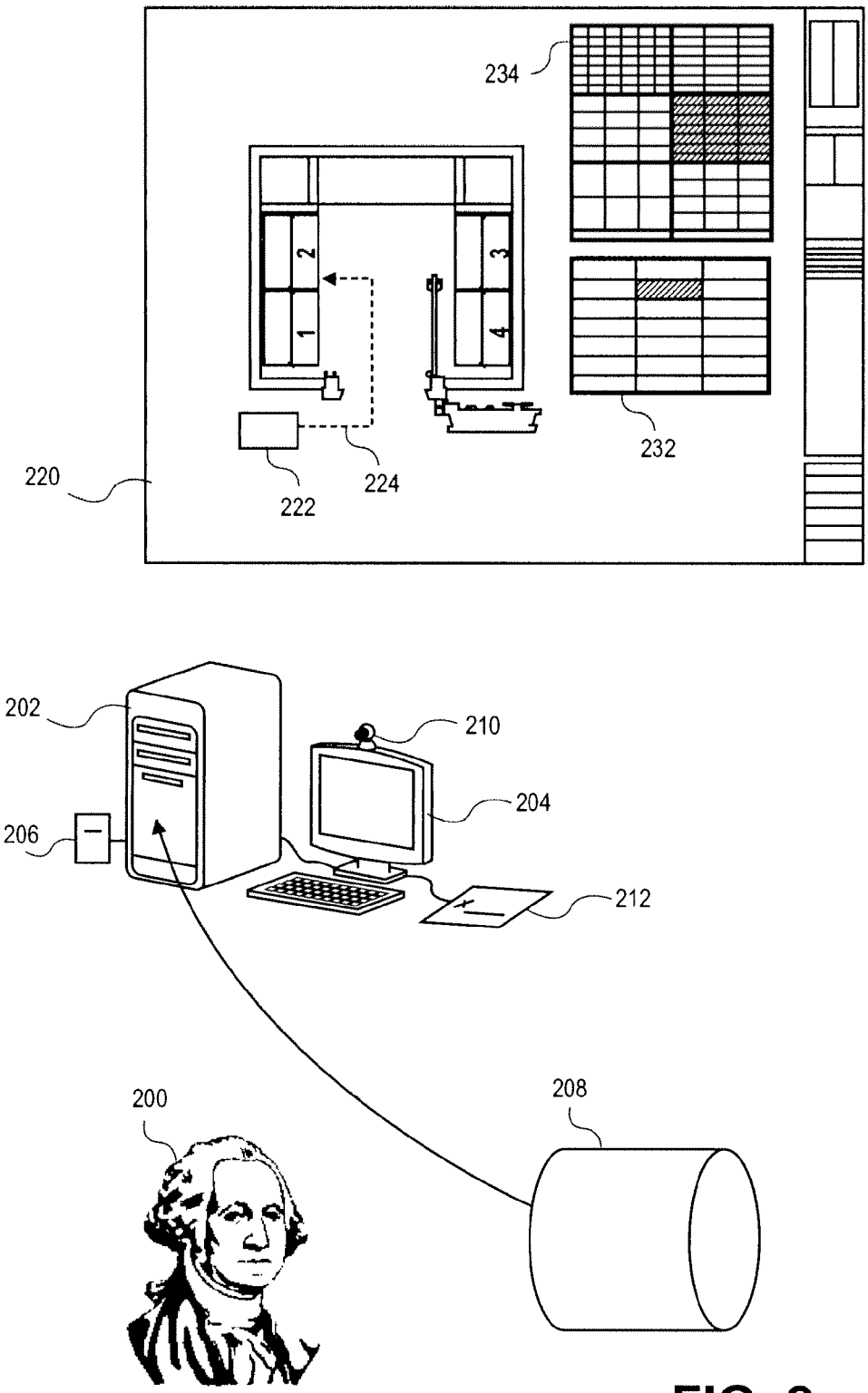
FIG. 2 is a schematic diagram of a system for controlling access to a vault according to one embodiment of the invention.

FIG. 2 is a schematic diagram of a system for controlling access to a vault according to one embodiment of the invention. An access computer 202 acts as a nerve center for controlling access to the vault. In one embodiment, a user 200 is required to login to access computer 202 to be electronically verified as authorized to access a resource within the vault.

A database 208 contains mappings of vault resources to authorized users. A camera 210 associated with access computer 202 captures an image of user 200 as part of the login process. That image may then be compared to previously archived images that are associated with the authorized user mappings in database 208. Database 208 may be local to access computer 202 or coupled thereto across a network.

In some embodiments, a user 200 is required to swipe an identification card (ID) such as a driver's license through card reader 206. Card reader 206 may capture information from both the magnetic strip on the back of the ID as well as (1) the user's signature and (2) the photographic image on the ID. The image captured by camera 210 during the login process may then be compared to archived images as well as the image captured from the ID. Dragnet Solutions, Inc. of Novato, Calif. provides one commercially available suitable tool for ID verification. If the comparison of any of the images fails, an alert may be signaled to bank personnel. Additionally, an electronic signature tablet 212 may be associated with access computer 202. In this manner, the signature of the user may be captured electronically and compared with a prior signature and/or the signature captured from the ID. Again, signature mismatches may be used to trigger an alert.

Assuming there no mismatch during the authorization process, display 204 will display a floor plan of the vault as image 220 with an icon 222 corresponding to the access computer and display a path 224 indicating the location within the vault of the authorized resource. Alternatively or concurrently, the display may show a schematic front view 234 of the stack (corresponding to 104 and 106 of FIG. 1B) with the nest containing the authorized resource highlighted. The display then also shows a schematic front view of the nest with the authorized resource (in this example corresponding to 1086 of FIG. 1B) highlighted. The access computer 202 may then unlock the day gate to permit access and, if provided, illuminate floor lighting (116 from FIG. 1A) or lights proximate (118 from FIG. 1A) to the resource to guide the user to the authorized resource. The access computer may also enable outward looking camera 122. Alternatively, outward looking camera could always be on.

Figure 3:
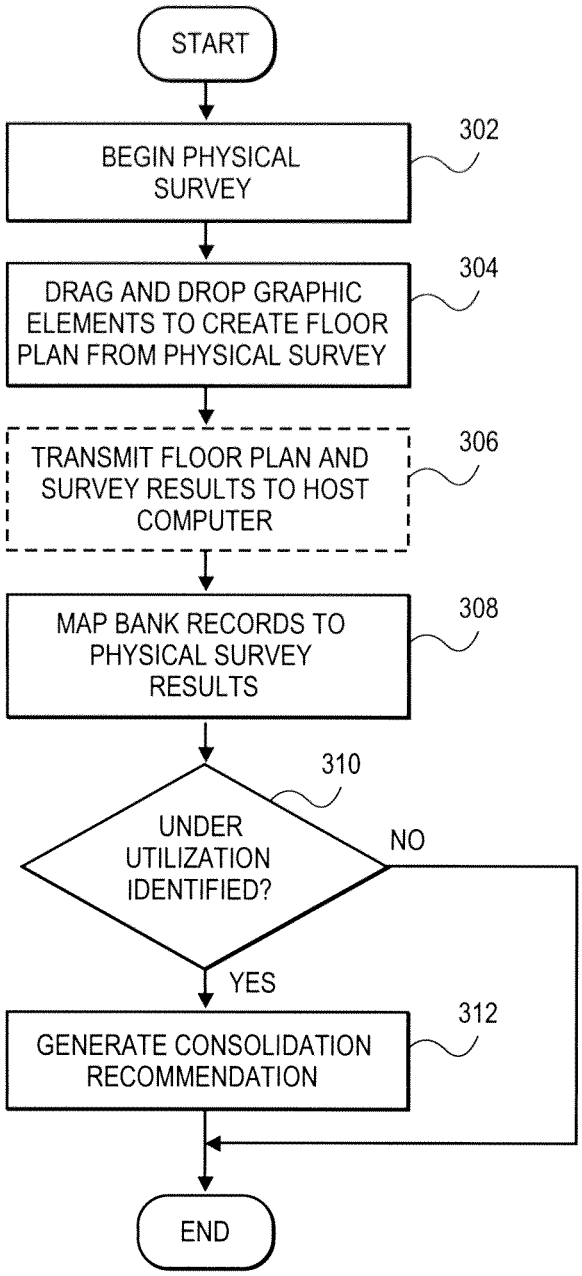
FIG. 3 is a flow diagram of operation of some embodiments of the invention.

FIG. 3 is a flow diagram of operation of some embodiments of the invention. At box 302, a physical survey of a vault is begun. A physical survey generally includes photographing and physically measuring vault features and dimensions. In some cases, a surveyor may have a handheld computer in which the digital images and survey data are retained. Because the data is acquired and initially input in electronic form it is immediately available for transmission to a central site for further processing or analysis.

At block 304, a floor plan is created by dragging and dropping graphic elements corresponding to the vault features which have been sized consistent with measured survey data. In some embodiments, the hand held computer may contain a library of graphic elements, such as walls, counters, stacks, day gates, vault doors, etc. This library permits the survey to grant drag and drop and scale these elements to create the floor plan, such as shown in FIG. 1A at the survey site. The floor plan and survey results may then be transmitted over a network from, for example, the handheld remote node to a host node (central repository) at block 306. In other embodiments, the surveyor brings the survey results back and enters them on the host directly and creates the floor plan on the host as well.

At the host, bank records may be mapped to the physical survey results at block 308. In one embodiment, the mapping is largely automatic with potential errors or exceptions being flagged for subsequent human review. In one embodiment, numbers are automatically assigned to the survey process includes an automated method of numbering the boxes and mapping their number to its respective box size and nest. This numbering method may be exercised at the time of the survey or in house from the photos taken during the survey. This information provides the physical location of each box and facilitates locating the resource for AU access. This aspect is described in further detail with reference to FIG. 4A below. It is this mapping that serves as the initial basis of the access computer's control of access to the vault, as discussed above in connection with FIG. 2. Also, part of the mapping is coordinates of the resource within the vault which permits the access computer to provide the signaling of the resource location for the user. Once the mapping is complete, it is possible to identify if, for example, some stacks or nests are underutilized. At block 310, a determination is made whether underutilization exists. If there is underutilization, a consolidation recommendation is generated at block 312. Different parameters may be used to determine how best to consolidate the nests. However, optimizing profit from the available space is one such criterion. For example, larger boxes may generate greater profit than smaller boxes. So, the consolidation recommendation may indicate to combine two nest with e.g., 60% and 30% small box utilization to achieve one nest of 90% utilization and then eliminate the vacant nest or convert it to a more desirable large box configuration. In some embodiments, various reports may be generated, such as a utilization summary by box size or an overall inventory report, which may allow, for example, utilization by nest to be calculated and displayed. A size summary utilization report provides an indication of which size boxes experience the greatest demand and may provide an indication of profitability. The inventory report may also be generated to provide a summary of important information, such as material and dimension of nests.

Figure 4A:
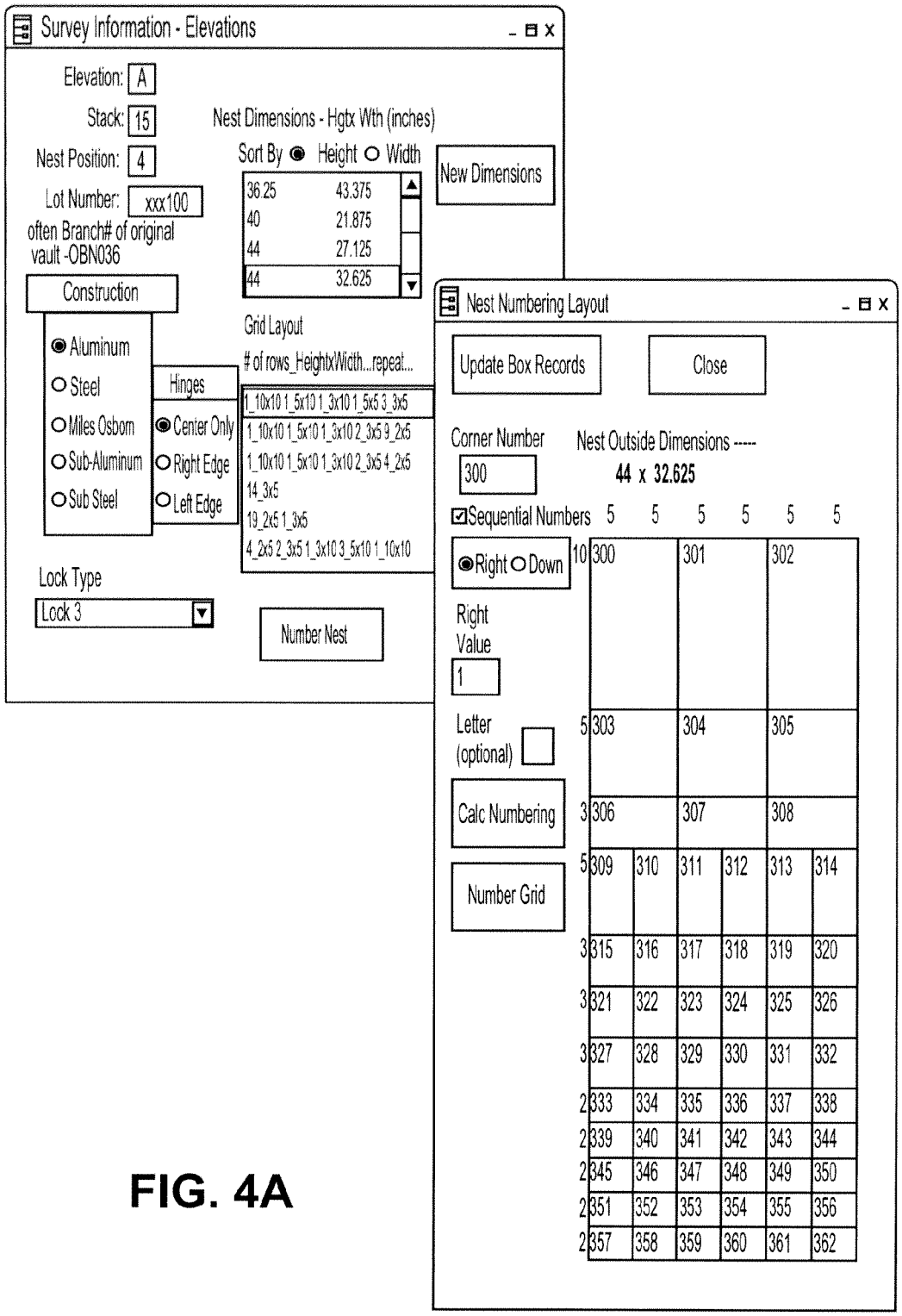
FIG. 4A is a screenshot of survey interface of one embodiment of the invention.

FIG. 4A is a screenshot of survey interface of one embodiment of the invention. In some embodiments, this interface may be provided on a mobile computer which allows the surveyor to enter all the information about the nests while physically present at the site. In other embodiments, this interface may be used in the office and filled in based on pictures of the vault taken during the survey. Information obtained in the survey information screen obtains all the information necessary for both nest elimination and future vault maintenance, for example, identifying and providing directions for a user to an authorized resource. A nest numbering layout screen allows the user to enter a corner number and sequential pattern indication. The nest then auto fills with numbering. A click of the update records soft button creates a record for each box containing relevant identifying information, such as number, size, suffix, physical location, and nest information. Once all nests have been entered and numbered, the numbering can be compared against the bank records. If the comparison fails to match, an exception report is provided to the surveyor.

FIG. 4B shows a screenshot of a matrix for use in nest elimination selection. To perform nest elimination, a matrix may be generated which identifies the percentage usage within each stack associated with resource size and absolute number of boxes rented. Where the percentage usage falls below a certain threshold, for example, thirty or forty percent, the nest may be targeted for possible elimination. A review of other nests having space available to accept the boxes from the potentially eliminated nest is then reviewed to ensure those boxes may be relocated to a nest with higher utilization. In one embodiment, the matrix keeps a running total of the impact of elimination decisions to ensure that proposed eliminations do not decrease inventory of available boxes below a threshold or make relocation of the in-use boxes from the eliminated nest impossible.

Figure 4C:
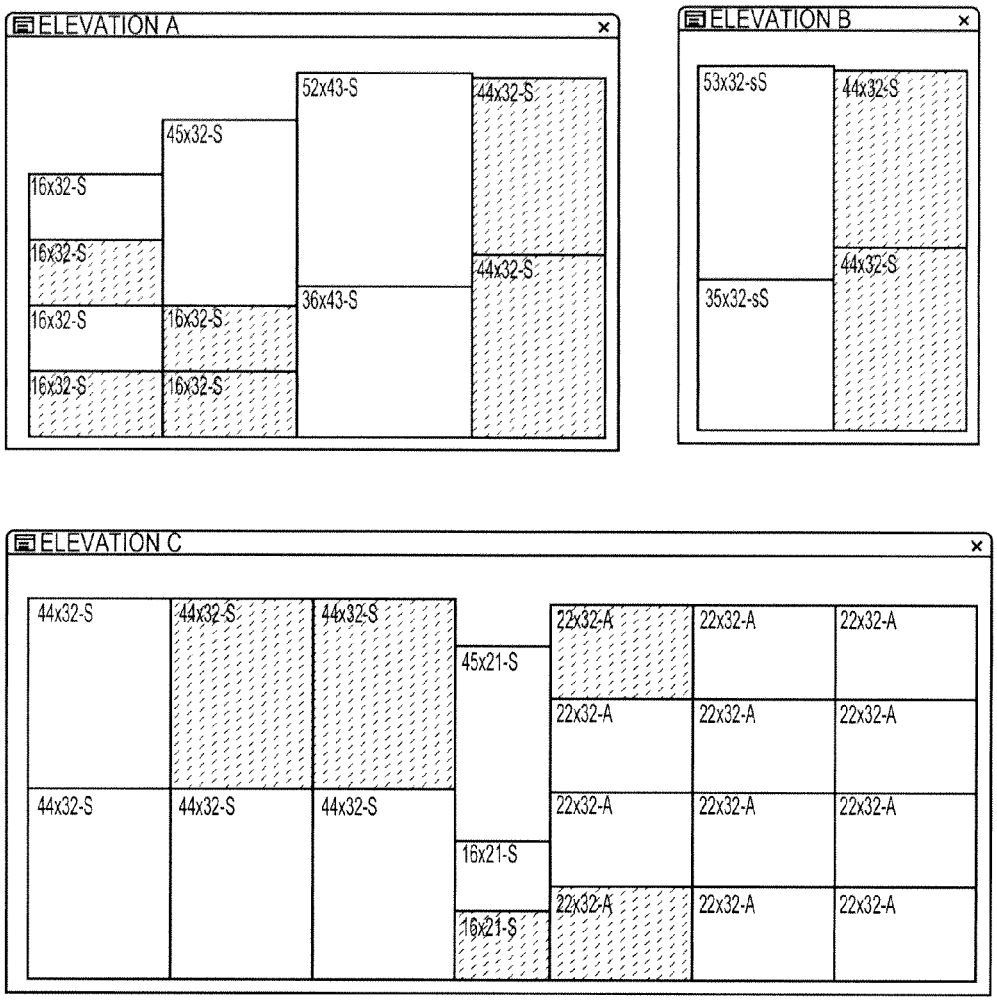
FIG. 4C is a screenshot reflecting proposed elimination of nests for a sample vault.

FIG. 4C is a screenshot reflecting proposed elimination of nests for a sample fault. Nests for proposed elimination are highlighted. Highlighting the nests gives the operator a visual idea of which nests selected for elimination reside. The same view may also be used by the crew that will be moving and restacking the nests as a visual confirmation that the correct nests have been removed.

Figure 5:
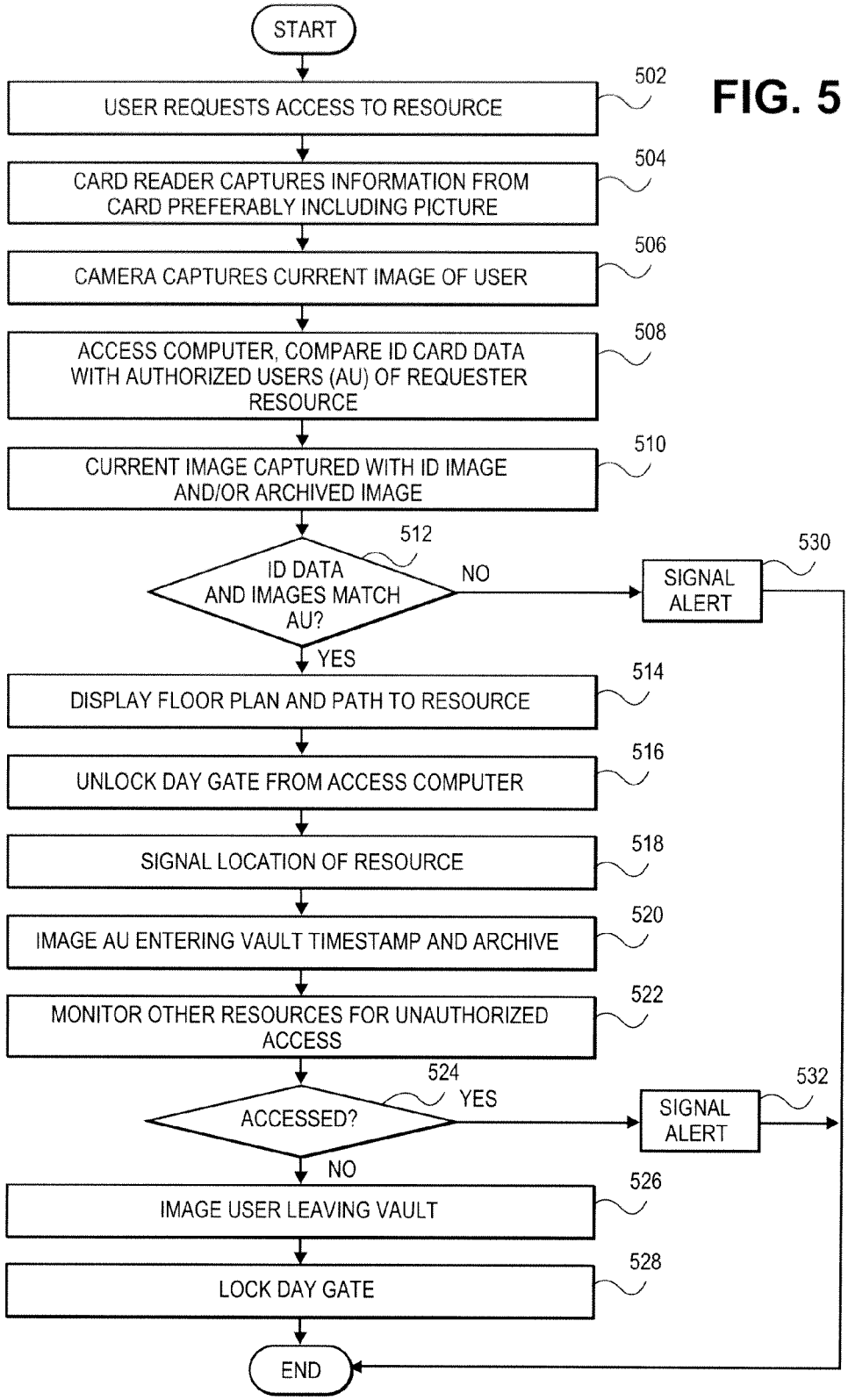
FIG. 5 is a flow diagram of operation of one embodiment of the invention.

FIG. 5 is a flow diagram of operation of one embodiment of the invention. At block 502, a user requests access to a resource such as, for example, a safety deposit box. At block 504, a card reader captures information from the ID card, preferably including a picture and possibly a signature. At block 506, a camera captures a current image of a user. This may be done as part of the process for logging into an access computer. At block 508, an access computer compares the ID card data with authorized user other requests for the resource. At block 510, the current captured image may be compared with the ID image and/or archived images retained in the system. At block 512, a determination is made if the ID data and images match an authorized user. If they do not, an alert is signaled at block 530. Notably, the signaling of an alert does not necessarily guarantee that the attempted access is fraudulent or that access will ultimately be denied, merely that bank employees should more closely review the access request. Assuming that the ID data and images match at decision block 512, a floor plan and a path to the resource is displayed at block 514. The day gate is unlocked from the access computer at block 516. A signal of the location of the resource within the vault, such highlighted the location on the access computer display, as floor path lighting or stack-proximate lighting, is engaged at block 518. At block 520, an image of an authorized user entering the vault is captured, time-stamped and archived for later reference and/or comparison.

While the user is in the vault, the other resources in the vault the day gate is locked are monitored for unauthorized access at block 522. If an unauthorized resource is accessed at block 524, an alert is signaled at block 532. Examples of unauthorized access may include where the user is in fact an authorized user of multiple safety deposit boxes but only logged in for access to one safety deposit box. If no unauthorized access is detected while the user is in the vault, the user's image leaving the vault is captured at block 526 and the day gate is relocked at 528. In one embodiment, an alert is also generated if a user has exceeded a defined amount of time in the vault. This allows a bank employee to check on the user to see if a problem or incident has occurred.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

In the foregoing specification, the invention has been described with reference to the specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. A method comprising:

physically surveying a vault;

creating a floor plan from the survey in a computer;

mapping bank records to the survey in the computer;

identifying from the mapping a level of resource utilization within a plurality of subgroups of resources; and generating a consolidation recommendation, in the computer, for two or more subgroups if utilization is below a threshold.

2. The method of claim 1 wherein creating a floor plan comprises:

dragging and dropping a plurality of graphical elements from a library of standard feature elements.

3. The method of claim 2 wherein the creating occurs on a remote node, further comprising:

transmitting the floor plan to a central repository.

4. The method of claim 1 wherein the physical survey identifies a plurality of safe deposit boxes and where in mapping comprises:

automatically assigning a number to each safe deposit box the number mapped to sizes and nests of respective boxes.

5. The method of claim 1 wherein the physical survey identifies a plurality of safe deposit boxes and where in mapping comprises:

determining coordinates for each safe deposit box within the vault.

* * * * *